US009810246B2

(12) United States Patent
Akiyama et al.

(10) Patent No.: US 9,810,246 B2
(45) Date of Patent: Nov. 7, 2017

(54) HYDRAULIC DRIVE SYSTEM

(75) Inventors: Teruo Akiyama, Kokubunji (JP); Noboru Iida, Chigasaki (JP); Kenji Oshima, Tokyo (JP); Koji Saito, Fujisawa (JP)

(73) Assignee: KOMATSU LTD., Tokyo (JP)

( * ) Notice: Subject to any disclaimer, the term of this patent is extended or adjusted under 35 U.S.C. 154(b) by 484 days.

(21) Appl. No.: 14/129,414

(22) PCT Filed: Aug. 13, 2012

(86) PCT No.: PCT/JP2012/070602

§ 371 (c)(1),
(2), (4) Date: Dec. 26, 2013

(87) PCT Pub. No.: WO2013/027619

PCT Pub. Date: Feb. 28, 2013

(65) Prior Publication Data

US 2014/0123639 A1 May 8, 2014

(30) Foreign Application Priority Data

Aug. 24, 2011 (JP) ..... 2011-182939

(51) Int. Cl.
*F15B 15/02* (2006.01)
*E02F 9/22* (2006.01)
*F15B 21/08* (2006.01)

(52) U.S. Cl.
CPC ..... *F15B 15/02* (2013.01); *E02F 9/2235* (2013.01); *E02F 9/2289* (2013.01);
(Continued)

(58) Field of Classification Search
CPC ..... F15B 11/046; F15B 11/048; F15B 13/16; F15B 13/04; E02F 9/2235; E02F 9/2289; E02F 9/2292; E02F 9/2296; E02F 9/2207
(Continued)

(56) References Cited

U.S. PATENT DOCUMENTS 4,358,989 A * 11/1982 Tordenmalm ..... E02F 9/2214 91/196
5,511,458 A * 4/1996 Kamata ..... E02F 9/2214 91/361
(Continued)

FOREIGN PATENT DOCUMENTS

CN 1818382 A 8/2006
JP 58-72507 U 5/1983
(Continued)

OTHER PUBLICATIONS

The Office Action for the corresponding Chinese application No. 201280040557.7, dated May 21, 2015.
(Continued)

*Primary Examiner* — Michael Leslie
*Assistant Examiner* — Richard Drake
(74) *Attorney, Agent, or Firm* — Global IP Counselors, LLP

(57) ABSTRACT

A hydraulic driving system includes a hydraulic cylinder with a cylinder tube and a cylinder rod, a main pump, a hydraulic-fluid path, a charge pump, a stroke position detecting unit, and a pump control unit. The hydraulic-fluid path forms a closed circuit between a main pump and the hydraulic cylinder. The cylinder rod expands or contracts depending on how hydraulic fluid is supplied and exhausted to and from first and second chambers. The charge pump replenishes hydraulic-fluid in the hydraulic-fluid path. The pump control unit performs flow-rate reduction control in which the pump control unit reduces a suction flow rate so that a suction flow rate of the main pump is equal to or less than a maximum discharge flow rate of the charge pump when the stroke position becomes closer to a stroke end of the cylinder rod than a prescribed reference position during the flow rate reduction control.

13 Claims, 7 Drawing Sheets

(52) U.S. Cl.
CPC ..... *E02F 9/2292* (2013.01); *E02F 9/2296* (2013.01); *F15B 21/087* (2013.01); *F15B 2211/20546* (2013.01); *F15B 2211/20561* (2013.01); *F15B 2211/20576* (2013.01); *F15B 2211/27* (2013.01); *F15B 2211/613* (2013.01); *F15B 2211/633* (2013.01); *F15B 2211/6336* (2013.01); *F15B 2211/6346* (2013.01); *F15B 2211/7053* (2013.01); *F15B 2211/785* (2013.01)

(58) Field of Classification Search
USPC ..... 91/361, 420
See application file for complete search history.

(56) References Cited

U.S. PATENT DOCUMENTS

| | | | | |
|---|---|---|---|---|
| 5,727,387 | A * | 3/1998 | Hosseini | E02F 3/434 60/327 |
| 7,318,292 | B2 * | 1/2008 | Helbling | E02F 9/2214 37/348 |
| 7,387,061 | B2 * | 6/2008 | Kobata | F15B 11/048 60/461 |
| 7,543,449 | B2 * | 6/2009 | Ivantysynova | F15B 7/006 60/464 |
| 2005/0196288 | A1 * | 9/2005 | Cherney | E02F 9/2217 417/199.1 |
| 2009/0064676 | A1 | 3/2009 | Tikkanen | |
| 2009/0151346 | A1 * | 6/2009 | Kim | E02F 3/325 60/428 |
| 2010/0115936 | A1 * | 5/2010 | Williamson | E02F 9/2207 60/327 |
| 2010/0162885 | A1 | 7/2010 | Hughes, IV et al. | |
| 2013/0263583 | A1 * | 10/2013 | Shin | E02F 9/2235 60/327 |

FOREIGN PATENT DOCUMENTS

| | | | |
|---|---|---|---|
| JP | 2002-54602 | A | 2/2002 |
| JP | 2005-249198 | A | 9/2005 |
| JP | 2009-511831 | A | 3/2009 |
| JP | 2009-257388 | A | 11/2009 |
| WO | 2007/140947 | A1 | 12/2007 |
| WO | 2010/054153 | A2 | 5/2010 |

OTHER PUBLICATIONS

International Search Report for PCT/JP2012/070602, dated Nov. 13, 2012.
Office Action for the corresponding German application No. 11 2012 003 474.0, dated Sep. 7, 2016.

* cited by examiner (a)

(b)

(a)

(b)

HYDRAULIC DRIVE SYSTEM

CROSS-REFERENCE TO RELATED APPLICATIONS

This application is a U.S. National stage application of International Application No. PCT/JP2012/070602, filed on Aug. 13, 2012. This U.S. National stage application claims priority under 35 U.S.C. §119(a) to Japanese Patent Application No. 2011-182939, filed in Japan on Aug. 24, 2011, the entire contents of which are hereby incorporated herein by reference.

BACKGROUND

Field of the Invention

The present invention relates to a hydraulic drive system.

Background Information

Work machines such as a hydraulic excavator or a wheel loader are equipped with working implement driven by a hydraulic cylinder. Hydraulic fluid discharged from a hydraulic pump is supplied to the hydraulic cylinder. The inside of the cylinder tube is partitioned by a cylinder rod into a first chamber and a second chamber. The cylinder rod expands due to hydraulic fluid being supplied to the first chamber and hydraulic fluid being exhausted from the second chamber. The cylinder rod contracts due to hydraulic fluid being supplied to the second chamber and hydraulic fluid being exhausted from the first chamber.

The hydraulic fluid is supplied via a hydraulic circuit to the hydraulic cylinder. For example, Japan Patent Laid-open Patent Publication JP-A-2009-511831 describes a work machine equipped with a hydraulic closed circuit for supplying hydraulic fluid to the hydraulic cylinder. Potential energy of the working implement is regenerated due to the hydraulic circuit being a closed circuit. As a result, fuel consumption of a motor for driving the hydraulic pump can be reduced.

SUMMARY

For example, when hydraulic fluid is supplied to a hydraulic motor instead of a hydraulic cylinder, via a closed hydraulic circuit, the hydraulic motor is able to continue running so long as the hydraulic fluid is supplied to the hydraulic motor. When the hydraulic motor is driven by an external force, the hydraulic motor is able to continue running so long as the external force acts on the hydraulic motor.

However, in the case of a hydraulic cylinder, when the cylinder rod reaches an end surface of the first chamber or the second chamber, the cylinder rod is not able to move any further. Accordingly, the flow rate of the hydraulic fluid returning from the hydraulic cylinder to the hydraulic pump becomes zero. Conversely, driving of the hydraulic pump continues due to the driving source. As a result, there is a shortage of hydraulic fluid being supplied to the hydraulic pump and the hydraulic pressure (called "suction pressure") in the hydraulic-fluid path supplying hydraulic fluid to the hydraulic pump momentarily has negative pressure. Thus, aeration or cavitation occurs and damage to the hydraulic pump may occur.

However, a charge circuit is often installed with the closed hydraulic circuit. The charge circuit is provided for replenishing an amount of hydraulic fluid corresponding to oil leakage from the hydraulic pump. When the flow rate of the hydraulic fluid supplied to the hydraulic pump is insufficient, the suction pressure falls below the hydraulic pressure of the charge circuit (referred to as "charge pressure" hereinbelow) and hydraulic fluid is supplied from the charge circuit to the hydraulic-fluid path. Therefore, as described above, the insufficient flow rate may be compensated by the hydraulic fluid from the charge circuit when the flow rate of the hydraulic fluid being supplied to the hydraulic pump is insufficient.

However, in this case, when the hydraulic pump is being driven at the maximum rotation speed, hydraulic fluid having a flow rate of the same degree as the maximum suction flow rate of the hydraulic pump needs to be replenished from the charge circuit. Therefore, it is necessary to use a charge pump having a discharge capacity equivalent to or higher than that of the main hydraulic pump, in the charge circuit. The use of such a charge pump leads to an increase in energy loss since the charge pump generates excessive horsepower that does not contribute to the power transmission. Moreover, the space for disposing the charge pump in a vehicle may become very large due to the increase in the size of the charge pump.

An object of the present invention is to provide a hydraulic drive system that is able to suppress the generation of a supply shortage of hydraulic fluid to a hydraulic pump and suppress an increase in the size of the charge pump.

A hydraulic drive system according to a first aspect of the present invention includes a hydraulic cylinder, a main pump, a hydraulic-fluid path, a charge pump, a stroke position detecting unit, and a pump control unit. The hydraulic cylinder includes a cylinder tube and a cylinder rod. The cylinder rod includes a proximal end part that is inserted inside the cylinder tube. The cylinder rod partitions the inside of the cylinder tube into a first chamber and a second chamber. The cylinder rod expands due to hydraulic fluid being supplied to the first chamber and hydraulic fluid being exhausted from the second chamber. The cylinder rod contracts due to hydraulic fluid being supplied to the second chamber and hydraulic fluid being exhausted from the first chamber. The main pump is switchable between a state of supplying hydraulic fluid to the first chamber and sucking in hydraulic fluid from the second chamber, and a state of supplying hydraulic fluid to the second chamber and sucking in hydraulic fluid from the first chamber. The hydraulic-fluid path connects the first chamber and the main pump and connects the second chamber and the main pump. The hydraulic-fluid path configures a closed circuit between the main pump and the hydraulic cylinder. A charge pump replenishes the hydraulic-fluid in the hydraulic-fluid path. The stroke position detecting unit detects a stroke position. The stroke position is a position of the proximal end part of the cylinder rod inside the cylinder tube. A pump control unit performs flow-rate reduction control. The pump control unit reduces a suction flow rate of the main pump so that the suction flow rate is equal to or less than a maximum discharge flow rate of the charge pump when the stroke position is closer to a stroke end of the cylinder rod than a prescribed reference position during the flow rate reduction control.

The hydraulic drive system according to a second aspect of the present invention is related to the hydraulic drive system of the first aspect, wherein the pump control unit controls the suction flow rate in accordance with flow rate reduction characteristics that prescribe a change in the suction flow rate with respect to the stroke position in the flow rate reduction control. The flow rate reduction characteristics have a reduction portion in which the suction flow rate becomes smaller as the stroke position approaches the stroke end. A change rate of the suction flow rate in the reduction portion of the flow rate reduction characteristics does not change regardless of the suction flow rate before execution of the flow rate reduction control.

The hydraulic drive system according to a third aspect of the present invention is related to the hydraulic drive system of the second aspect, wherein the stroke position when the reduction of the suction flow rate has started is closer to the stroke end in correspondence to a reduction in the size of the suction flow rate before the execution of the flow rate reduction control.

The hydraulic drive system according to a fourth aspect of the present invention is related to the hydraulic drive system of the first aspect, wherein the pump control unit controls the suction flow rate in accordance with flow rate reduction characteristics that prescribe a change in the suction flow rate with respect to the stroke position in the flow rate reduction control. The flow rate reduction characteristics have a reduction portion in which the suction flow rate is reduced as the stroke position approaches the stroke end. A change rate of the suction flow rate in the reduction portion of the flow rate reduction characteristics changes in response to the suction flow rate before the execution of the flow rate reduction control.

The hydraulic drive system according to a fifth aspect of the present invention is related to the hydraulic drive system of the fourth aspect, wherein a change rate of the suction flow rate in the reduction portion of the flow rate reduction characteristics becomes smaller in correspondence to a reduction in the size of the suction flow rate before the execution of the flow rate reduction control.

The hydraulic drive system according to a sixth aspect of the present invention is related to the hydraulic drive system of the fifth aspect, wherein the stroke position when the reduction of the suction flow rate has started is the same regardless of the suction flow rate before the execution of the flow rate reduction control.

The hydraulic drive system according to a seventh aspect of the present invention is related to the hydraulic drive system of any one of the second to sixth aspects, wherein the suction flow rate is maintained at a prescribed flow rate equal to or less than the maximum discharge flow rate of the charge pump in a prescribed range of the stroke position that includes the stroke end in the flow rate reduction characteristics.

The hydraulic drive system according to an eighth aspect of the present invention is related to any of the hydraulic drive systems according to the second to sixth aspects, wherein the suction flow rate becomes smaller as the stroke position approaches the stroke end, and the suction flow rate reaches zero when the stroke position reaches the stroke end in the flow rate reduction characteristics.

The hydraulic drive system according to a ninth aspect of the present invention is related to any of the hydraulic drive systems according to the second to sixth aspects, wherein the suction flow rate becomes smaller as the stroke position approaches the stroke end, and the suction flow rate reaches zero before the stroke position reaches the stroke end, in the flow rate reduction characteristics.

The hydraulic drive system according to a tenth aspect of the present invention is related to any one of the second to sixth aspects, and further includes an expansion/contraction determining unit. The expansion/contraction determining unit determines whether the hydraulic cylinder is operating by expanding or contracting. When the hydraulic cylinder is expanding, the pump control unit controls the suction flow rate in accordance with the flow rate reduction characteristics for an expansion operation in the flow rate reduction control. When the hydraulic cylinder is contracting, the pump control unit controls the suction flow rate in accordance with the flow rate reduction characteristics for a contraction operation in the flow rate reduction control.

The hydraulic drive system according to an eleventh aspect of the present invention is related to the hydraulic drive system of the tenth aspect, and further includes an operating member for operating the hydraulic cylinder. The expansion/contraction determining unit determines whether the cylinder rod is moving in an expansion direction or a contraction direction from detection results of the stroke position detecting unit. The expansion/contraction determining unit determines that the cylinder rod in is the expansion operation or the contraction operation when the moving direction of the cylinder rod matches an operation direction of the operating member.

The hydraulic drive system according to a twelfth aspect of the present invention is related to the hydraulic drive system of the tenth aspect, wherein the flow rate of hydraulic fluid returning from the hydraulic cylinder to the main pump during a contraction operation is larger than a flow rate of hydraulic fluid returning from the hydraulic cylinder to the main pump during an expansion operation.

The pump control unit in the hydraulic drive system according to the first aspect of the present invention reduces the suction flow rate so that the suction flow rate of the main pump is equal to or less than the maximum discharge flow rate of the charge pump when the stroke position approaches the stroke end of the cylinder rod in the flow rate reduction control. When the cylinder rod reaches the stroke end and the suction pressure is reduced, the shortage of hydraulic fluid is replenished by hydraulic fluid from the charge pump. Since the suction flow rate of the main pump is reduced by the flow rate reduction control at this time, the amount of hydraulic fluid required for replenishing is smaller. Therefore, the shortage of hydraulic fluid can be replenished with hydraulic fluid from the charge pump without making the charge pump larger. As a result, a hydraulic drive system can be provided that is able to suppress the generation of a supply shortage of hydraulic fluid to a hydraulic pump and suppress an increase in the size of a charge pump.

Since the suction flow rate is reduced in accompaniment to the stroke position approaching the stroke end in the hydraulic drive system according to the second aspect of the present invention, it can be suppressed that the movement of the hydraulic cylinder become slow drastically. Moreover, since the change rate of the suction flow rate in the reduction portion of the flow rate reduction characteristics does not change regardless of the suction flow rate before the execution of the flow rate reduction control, variations in changes of the operation speed of the hydraulic cylinder can be suppressed.

The flow rate reduction characteristics can be set easily so that the change rate of the suction flow rate in the reduction portion of the flow rate reduction characteristics does not change regardless of the suction flow rate before the execution of the flow rate reduction control.

The suction flow rate is reduced in accompaniment to the stroke position approaching the stroke end in the hydraulic drive system according to the fourth aspect of the present invention. As a result, it can be suppressed that the movement of the hydraulic cylinder become slow drastically. Since the change rate of the suction flow rate in the reduction portion of the flow rate reduction characteristics changes in response to the suction flow rate before the execution of the flow rate reduction control, the suction flow rate can be reduced at a suitable change rate in accordance with conditions before the execution of the flow rate reduction control.

The suction flow rate can be reduced at a change rate suitable to the conditions before the execution of the flow rate reduction control in the hydraulic drive system according to the fifth aspect of the present invention.

Since the stroke position when the reduction of the suction flow rate is started is the same regardless of the suction flow rate before the execution of the flow rate reduction control in the hydraulic drive system according to the sixth aspect of the present invention, variation in the timing when the movement of the hydraulic cylinder become slow can be suppressed.

Hydraulic fluid at a prescribed flow rate is sucked into the main pump and discharged from the main pump even when the stroke position reaches the stroke end in the hydraulic drive system according to the seventh aspect of the present invention. Therefore, the proximal end part of the cylinder rod moves at a prescribed speed and touches the end part on the inside surface of the cylinder tube. As a result, the operator is able to easily know when the stroke position reaches the stroke end.

The suction flow rate reaches zero when the stroke position reaches the stroke end in the hydraulic drive system according to the eighth aspect of the present invention. As a result, the proximal end part of the cylinder rod makes contact with the end part of the inside surface of the cylinder tube in a gentle manner.

The suction flow rate reaches zero before the stroke position reaches the stroke end in the hydraulic drive system according to the ninth aspect of the present invention. As a result, the proximal end part of the cylinder rod makes contact with the end part of the inside surface of the cylinder tube in a gentle manner. Moreover, the suction flow rate is reduced to zero in a more reliable manner at the point in time that the stroke position reaches the stroke end.

The control of the suction flow rate can be accomplished according to different flow rate reduction characteristics during a hydraulic cylinder contraction and an expansion in the hydraulic drive system according to the tenth aspect of the present invention. As a result, the suction flow rate can be controlled with flow rate reduction characteristics that suit the operating state of the hydraulic cylinder.

Whether the cylinder rod is expanding or contracting is determined due to both the operating direction of the operating member and the moving direction of the cylinder rod in the hydraulic drive system according to the eleventh aspect of the present invention. As a result, suitable flow rate reduction characteristics can be selected even if for example the hydraulic cylinder moves in a direction opposite the operating direction of the operating member due to inertia immediately after the operating direction of the operating member is switched to the opposite direction.

The flow rate of hydraulic fluid returning from the hydraulic cylinder to the main pump during a contraction operation is larger than the flow rate of hydraulic fluid returning from the hydraulic cylinder to the main pump during an expansion operation in the hydraulic drive system according to a twelfth aspect of the present invention. As a result, a suction flow rate control can be performed that is suitable for different hydraulic fluid return flow rates according to whether the flow rate reduction characteristics during a contraction or the flow rate reduction characteristics during an expansion are used.

DETAILED DESCRIPTION OF EMBODIMENT(S)

Figure 1:
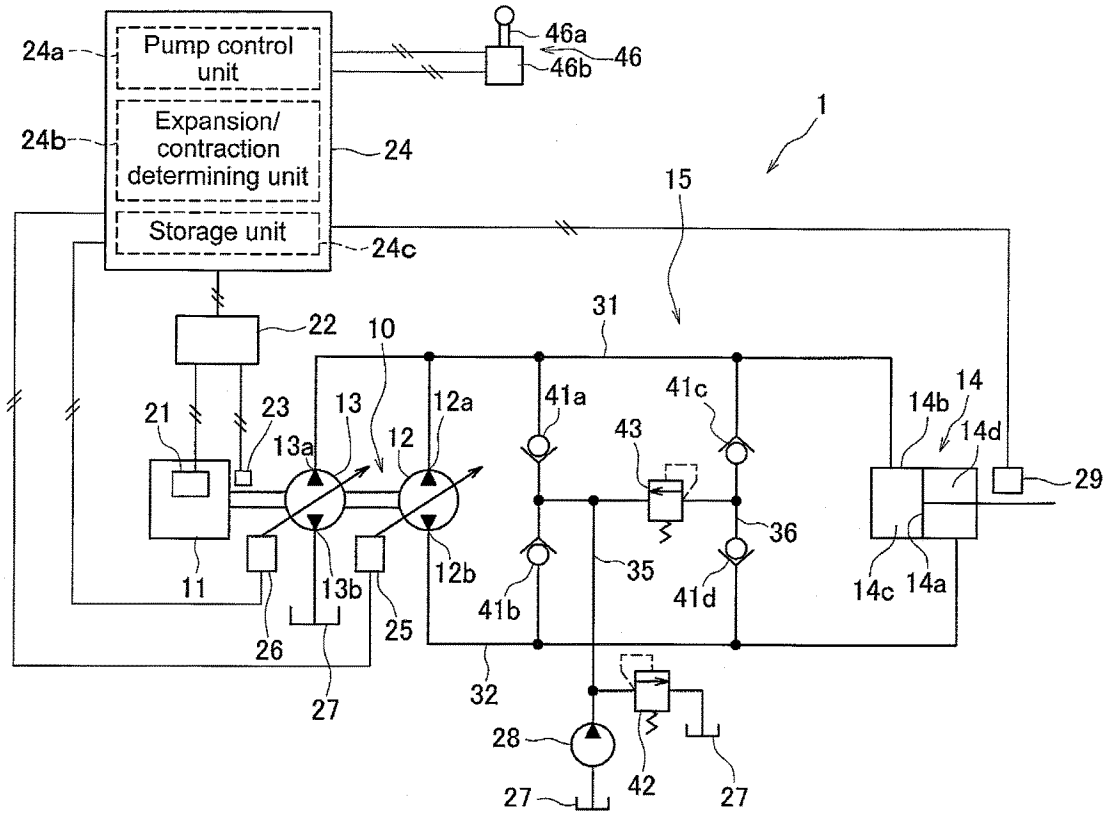
FIG. 1 is a block diagram of a configuration of a hydraulic drive system according to an embodiment of the present invention.

A hydraulic drive system according to an embodiment of the present invention shall be explained in detail with reference to the figures. FIG. 1 is a block diagram of a configuration of a hydraulic drive system 1 according to an embodiment of the present invention. The hydraulic drive system 1 is installed on a work machine such as a hydraulic excavator, a wheel loader, or a bulldozer. The hydraulic drive system 1 includes an engine 11, a main pump 10, a hydraulic cylinder 14, a hydraulic-fluid path 15, and a pump controller 24.

The engine 11 drives a first hydraulic pump 12 and a second hydraulic pump 13. The engine 11 is an example of a driving source in the present invention. The engine 11 is a diesel engine, for example, and the output of the engine 11 is controlled by adjusting an injection amount of fuel from a fuel injection device 21. The adjustment of the fuel injection amount is performed by the engine controller 22 controlling the fuel injection device 21. An actual rotation speed of the engine 11 is detected by a rotation speed sensor 23. The detection signal of the rotation speed sensor 23 is input into the engine controller 22 and the pump controller 24.

The main pump 10 is driven by the engine 11 to discharge hydraulic fluid. The main pump 10 includes the first hydraulic pump 12 and the second hydraulic pump 13. The hydraulic fluid discharged from the main pump 10 is supplied to the hydraulic cylinder 14.

The first hydraulic pump 12 is a variable displacement hydraulic pump. The discharge flow rate of the first hydraulic pump 12 is controlled by controlling a tilt angle of the first hydraulic pump 12. In other words, the suction flow rate of the first hydraulic pump 12 is controlled by controlling a tilt angle of the first hydraulic pump 12. The tilt angle of the first hydraulic pump 12 is controlled by a first pump-flow-rate control unit 25. The first pump-flow-rate control unit 25 controls the discharge flow rate of the first hydraulic pump 12 by controlling the tilt angle of the first hydraulic pump 12 on the basis of a command signal from the pump controller 24. The first hydraulic pump 12 is a two-directional discharge hydraulic pump.

Specifically, the first hydraulic pump 12 has a first pump port 12*a* and a second pump port 12*b*. The first hydraulic pump 12 is switchable between a first discharge state and a second discharge state. Hydraulic fluid is supplied to the second pump port 12*b* in the first hydraulic pump 12, and the first hydraulic pump 12 discharges hydraulic fluid from the first pump port 12*a* in the first discharge state. The first hydraulic pump 12 supplies hydraulic fluid to the first pump port 12*a* and discharges hydraulic fluid from the second pump port 12*b* in the second discharge state.

The second hydraulic pump 13 is a variable displacement hydraulic pump. The discharge flow rate of the second hydraulic pump 13 is controlled by controlling the tilt angle of the second hydraulic pump 13. In other words, the suction flow rate of the second hydraulic pump 13 is controlled by controlling the tilt angle of the second hydraulic pump 13. The tilt angle of the second hydraulic pump 13 is controlled by a second pump-flow-rate control unit 26. The second pump-flow-rate control unit 26 controls the discharge flow rate of the second hydraulic pump 13 by controlling the tilt angle of the second hydraulic pump 13 on the basis of a command signal from the pump controller 24. The second hydraulic pump 13 is a two-directional discharge hydraulic pump.

Specifically, the second hydraulic pump 13 has a first pump port 13*a* and a second pump port 13*b*. The second hydraulic pump 13 is switchable between a first discharge state and a second discharge state in the same way as the first hydraulic pump 12. Hydraulic fluid is supplied to the second pump port 13*b* in the second hydraulic pump 13, and the second hydraulic pump 13 discharges hydraulic fluid from the first pump port 13*a* in the first discharge state. Hydraulic fluid is supplied to the first pump port 13*a* in the second hydraulic pump 13, and the second hydraulic pump 13 discharges hydraulic fluid from the second pump port 13*b* in the second discharge state.

The hydraulic cylinder 14 is driven by hydraulic fluid discharged from the first hydraulic pump 12 and the second hydraulic pump 13. The hydraulic cylinder 14 drives working implement such as a boom, an arm, or a bucket. The hydraulic cylinder 14 includes a cylinder rod 14*a* and a cylinder tube 14*b*. The cylinder rod 14*a* partitions the inside of the cylinder tube 14*b* into a first chamber 14*c* and a second chamber 14*d*. The cylinder rod 14*a* includes a proximal end part that is inserted inside the cylinder tube 14*b*.

The hydraulic cylinder 14 expands and contracts by switching between the supply and exhaust of hydraulic fluid to and from the first chamber 14*c* and the second chamber 14*d*. Specifically, the hydraulic cylinder 14 expands due to the supply of hydraulic fluid into the first chamber 14*c* and the exhaust of hydraulic fluid from the second chamber 14*d*. The hydraulic cylinder 14 contracts due to the supply of hydraulic fluid into the second chamber 14*d* and the exhaust of hydraulic fluid from the first chamber 14*c*. A pressure receiving area of the cylinder rod 14*a* in the first chamber 14*c* is greater than a pressure receiving area of the cylinder rod 14*a* in the second chamber 14*d*. Therefore, when the hydraulic cylinder 14 is expanded, more hydraulic fluid is supplied to the first chamber 14*c* than is exhausted from the second chamber 14*d*. When the hydraulic cylinder 14 is contracted, more hydraulic fluid is exhausted from the first chamber 14*c* than is supplied to the second chamber 14*d*.

The hydraulic-fluid path 15 is connected to the first hydraulic pump 12, the second hydraulic pump 13, and the hydraulic cylinder 14. The hydraulic-fluid path 15 connects the first chamber 14*c* and the first pump port 12*a*, and connects the second chamber 14*d* and the second pump port 12*b*. The hydraulic-fluid path 15 configures a closed circuit between the main pump 10 and the hydraulic cylinder 14.

Specifically, the hydraulic-fluid path 15 includes a first path 31 and a second path 32. The first path 31 connects the first chamber 14*c* of the hydraulic cylinder 14 with the first pump port 12*a* of the first hydraulic pump 12. The first path 31 is a path for supplying hydraulic fluid to the first chamber 14*c* of the hydraulic cylinder 14, or for recovering hydraulic fluid from the first chamber 14*c* of the hydraulic cylinder 14. The first path 31 is connected to the first pump port 13*a* of the second hydraulic pump 13. Therefore, hydraulic fluid is supplied to the first path 31 from both the first hydraulic pump 12 and the second hydraulic pump 13.

The second path 32 is connected to the second chamber 14*d* of the hydraulic cylinder 14 and to the second pump port 12*b* of the first hydraulic pump 12. The second path 32 is a path for supplying hydraulic fluid to the second chamber 14*d* of the hydraulic cylinder 14, or for recovering hydraulic fluid from the second chamber 14*d* of the hydraulic cylinder 14. The second pump port 13*b* of the second hydraulic pump 13 is connected to a hydraulic fluid tank 27. Therefore, hydraulic fluid from the first hydraulic pump 12 is supplied to the second path 32. The hydraulic-fluid path 15 configures a closed circuit between the main pump 10 and the hydraulic cylinder 14 with the first path 31 and the second path 32.

The hydraulic drive system 1 further includes a charge pump 28. The charge pump 28 is a hydraulic pump for replenishing hydraulic fluid to the hydraulic-fluid path 15. The charge pump 28 is driven by the engine 11 to discharge hydraulic fluid. The charge pump 28 is a fixed displacement hydraulic pump.

The hydraulic-fluid path 15 further includes a charge path 35. The charge path 35 connects the charge pump 28 with the first path 31. The charge path 35 also connects the charge pump 28 with the second path 32. Specifically, the charge path 35 is connected to the first path 31 via a check valve 41*a*. The check valve 41*a* is open when the hydraulic pressure of the first path 31 is lower than the hydraulic pressure of the charge path 35. The charge path 35 is connected to the second path 32 via a check valve 41*b*. The check valve 41*b* is open when the hydraulic pressure of the second path 32 is lower than the hydraulic pressure of the charge path 35.

The charge path 35 is also connected to the hydraulic fluid tank 27 via a charge relief valve 42. The charge relief valve 42 maintains the hydraulic pressure in the charge path 35 at a prescribed charge pressure. When the hydraulic pressure of the first path 31 or the second path 32 becomes lower than the hydraulic pressure in the charge path 35, hydraulic fluid from the charge pump 28 is supplied to the first path 31 or the second path 32 via the charge path 35. As a result, the hydraulic pressure in the first path 31 and the second path 32 is maintained at a prescribed pressure or greater.

The hydraulic-fluid path 15 further includes a relief path 36. The relief path 36 is connected to the first path 31 via a check valve 41*c*. The check valve 41*c* is open when the hydraulic pressure of the first path 31 is higher than the hydraulic pressure of the relief path 36. The relief path 36 is connected to the second path 32 via a check valve 41*d*. The check valve 41*c* is open when the hydraulic pressure of the second path 32 is higher than the hydraulic pressure of the relief path 36. The relief path 36 is connected to the charge path 35 via the relief valve 43. The relief valve 43 maintains the pressure of the relief path 36 at a pressure equal to or less than a prescribed relief pressure. As a result, the hydraulic pressure of the first path 31 and the second path 32 is maintained at a prescribed pressure equal to or less than the prescribed relief pressure.

When the hydraulic cylinder 14 is expanded, the first hydraulic pump 12 and the second hydraulic pump 13 are driven in a first discharge state. As a result, the main pump 10 enters a state of supplying hydraulic fluid to the first chamber 14*c* and sucking in hydraulic fluid from the second chamber 14*d*. Specifically, hydraulic fluid discharged from the first pump port 12*a* of the first hydraulic pump 12 and from the first pump port 13*a* of the second hydraulic pump 13 passes through the first path 31 and is supplied to the first chamber 14*c* of the hydraulic cylinder 14.

The hydraulic fluid in the second chamber 14*d* of the hydraulic cylinder 14 passes through the second path 32 and is recovered in the second pump port 12*b* of the first hydraulic pump 12. As a result, the hydraulic cylinder 14 expands.

When the hydraulic cylinder 14 is contracted, the first hydraulic pump 12 and the second hydraulic pump 13 are driven in the second discharge state. As a result, the main pump 10 enters a state of supplying hydraulic fluid to the second chamber 14*d* and sucking in hydraulic fluid from the first chamber 14*c*. Specifically, hydraulic fluid discharged from the second pump port 12*b* of the first hydraulic pump 12 passes through the second path 32 to be supplied to the second chamber 14*d* of the hydraulic cylinder 14. The hydraulic fluid in the first chamber 14*c* of the hydraulic cylinder 14 passes through the first path 31 to be recovered in the first pump port 12*a* of the first hydraulic pump 12 and in the first pump port 13*a* of the second hydraulic pump 13. As a result, the hydraulic cylinder 14 contracts.

The hydraulic drive system 1 further includes a stroke position detecting unit 29. The stroke position detecting unit 29 detects a stroke position. The stroke position is a position of the proximal end part of the cylinder rod 14*a* inside the cylinder tube 14*b*. The stroke position detecting unit 29 detects, for example, a swing angle of a working implement member such as the boom, the arm, or the bucket driven by the hydraulic cylinder 14. The below mentioned pump controller 24 is able to calculate the stroke position from the swing angle of the working implement member. The stroke position detecting unit 29 may also be a sensor for detecting the stroke amount of the cylinder rod 14*a*.

The hydraulic drive system 1 further includes an operating device 46. The operating device 46 includes an operating member 46*a* and an operation detecting unit 46*b*. The operating member 46*a* is operated by an operator in order to command various types of operations of the work machine. For example, when the hydraulic cylinder 14 is a boom cylinder for driving a boom, the operating member 46*a* is a boom operating lever for operating the boom. Specifically, the operating member 46 is operated by the operator for operating the hydraulic cylinder 14.

The operating member 46*a* can be operated in two directions: a direction for expanding the hydraulic cylinder 14 from a neutral position, and a direction for contracting the hydraulic cylinder 14 from the neutral position. The operation detecting unit 46*b* detects the operation amount and the operation direction of the operating member 46*a*. The operation detecting unit 46*b* is a sensor for detecting a position of the operating member 46*a* for example. When the operating member 46 is positioned in the neutral position, the operation amount of the operating member 46*a* is zero. Detection signals that indicate the operation amount and the operation direction of the operating member 46*a* are input from the operation detecting unit 46*b* to the pump controller 24.

The engine controller 22 controls the output of the engine 11 by controlling the fuel injection device 21. Engine output torque characteristics determined on the basis of a set target engine rotation speed and a work mode are mapped and stored in the engine controller 22. The engine output torque characteristics indicate the relationship between the output torque and the rotation speed of the engine 11. The engine controller 22 controls the output of the engine 11 on the basis of the engine output torque characteristics.

The pump controller 24 controls the first hydraulic pump 12 and the second hydraulic pump 13 in response to the operation amount of the operating member 46*a*. The pump controller 24 includes a pump control unit 24*a*, an expansion/contraction determining unit 24*b*, and a storage unit 24*c*. The pump control unit 24*a* and the expansion/contraction determining unit 24*b* may be realized by a calculation device such as a CPU or the like. The storage unit 24*c* may be realized by a recording device such as a RAM, a ROM, a hard disk, a flash memory, or the like. The storage unit 24*c* stores information for controlling the first hydraulic pump 12 and the second hydraulic pump 13.

The pump controller 24 calculates a target flow rate of the hydraulic fluid supplied to the hydraulic cylinder 14 in response to the operation amount of the operating member 46*a*. The pump control unit 24*a* executes a flow rate reduction control. The flow rate reduction control is a control for reducing a suction flow rate so that the suction flow rates of the first hydraulic pump 12 and the second hydraulic pump 13 are equal to or less than a maximum discharge flow rate of the charge pump 35 when the stroke position becomes closer to a stroke end of the cylinder rod 14*a* than a prescribed reference position. The flow rate reduction control is described in detail below.

The expansion/contraction determining unit 24*b* determines whether the hydraulic cylinder is operating by expanding or contracting. The expansion/contraction determining unit 24*b* determines whether the cylinder rod is moving in an expansion direction or a contraction direction from detection results of the stroke position detecting unit 29 and detection results of the operation detecting unit 46*b*. The expansion/contraction determining unit 24*b* determines that the cylinder rod 14*a* in is an expansion operation or a contraction operation when the moving direction of the cylinder rod 14*a* matches an operation direction of the operating member 46*a*.

Figure 2:
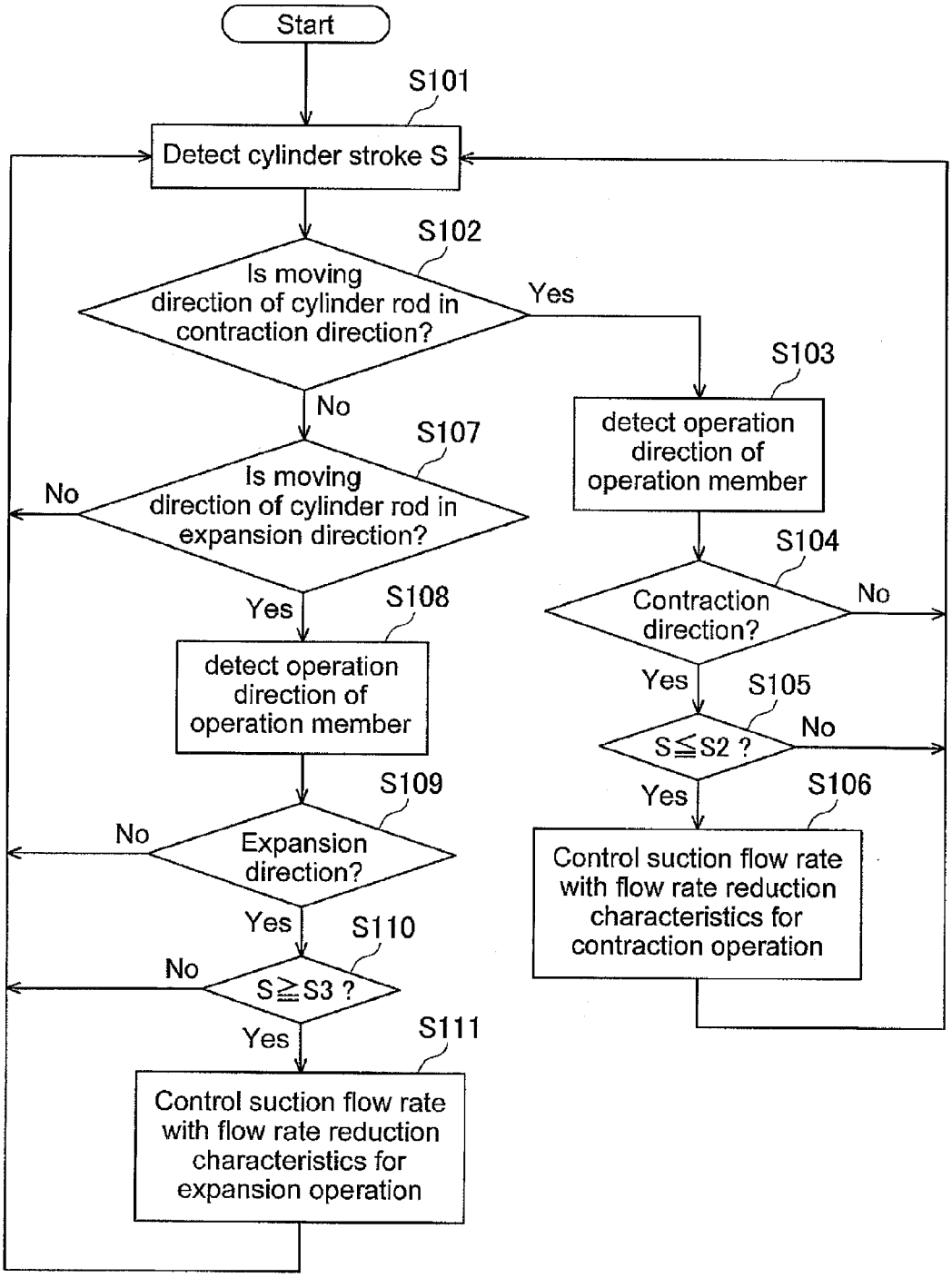
FIG. 2 is a flow chart describing control for suction flow rate in the hydraulic drive system.

Processing during the flow rate reduction control is described hereinbelow with reference to the flow chart in FIG. 2.

In step S101, a stroke position S is detected by the stroke position detecting unit 29. In step S102, a determination is made as to whether the moving direction of the cylinder rod 14*a* is in the contraction direction. For example, a determination is made as to whether the moving direction of the cylinder rod 14*a* is in the contraction direction on the basis of a change in the cylinder position. The stroke position S is represented by a value that becomes larger as the stroke position S approaches the stroke end during an expansion operation with the stroke end being zero during a contraction operation. The process advances to step S103 of the moving direction of the cylinder rod 14*a* is in the contraction direction.

In step S103, the operation direction of the operating member 46*a* is detected by the operation detecting unit 46*b*. Next, in step S104, a determination is made as to whether the operation direction of the operating member 46*a* is the contraction direction. The process advances to step S105 if the operation direction of the operating member 46*a* is the contraction direction. In step S105, a determination is made as to whether the stroke position S is equal to or less than a reduction start position S2 during the contraction operation. The process advances to step S106 if the stroke position S is equal to or less than the reduction start position S2.

Figure 3:
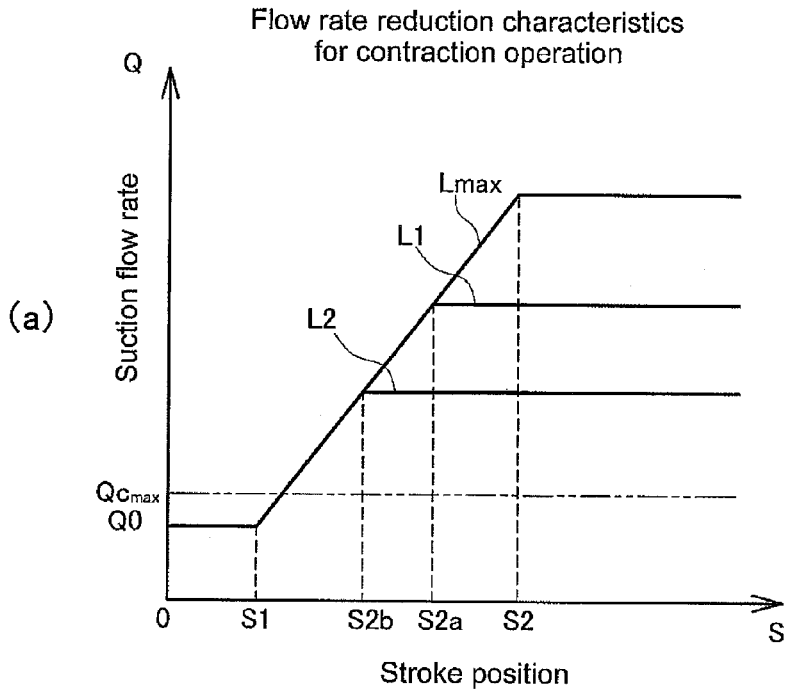
FIG. 3 illustrates graphs describing flow rate reduction characteristics in the hydraulic drive system.
Figure 3:
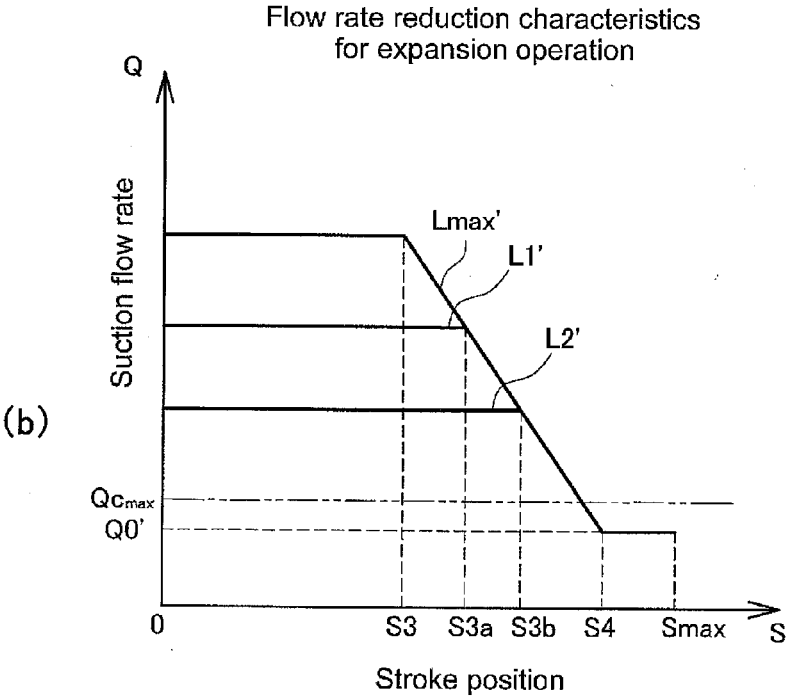

In step S106, the suction flow rate of the first hydraulic pump 12 and the second hydraulic pump 13 is controlled according to the flow rate reduction characteristics during a contraction operation. The flow rate reduction characteristics prescribe changes in the suction flow rate with respect to the stroke position S. As illustrated in FIG. 3(*a*), the flow rate reduction characteristics prescribe changes in the suction flow rate with respect to the stroke position S so that the suction flow rate of the first hydraulic pump 12 and the second hydraulic pump 13 when the stroke position S becomes closer to the stroke end on the contraction side than a reference position S1 during the contraction operation, is equal to or less than a maximum discharge flow rate Qcmax of the charge pump 28. FIG. 3(*a*) illustrates changes in the total suction flow rate of the first hydraulic pump 12 and the second hydraulic pump 13. The flow rate reduction control during a contraction operation is described in detail below.

When a determination is made in step S104 that the operation direction of the operating member 46*a* is not the contraction direction, the process returns to step S101. When a determination is made in step S105 that the stroke position S is not equal to or less than the reduction start position S2 during a contraction operation, the process returns to step S101.

The process advances to step S107 if it is determined in step S102 that the moving direction of the cylinder rod 14*a* is not in the contraction direction. In step S107, a determination is made as to whether the moving direction of the cylinder rod 14*a* is in the expansion direction. The process advances to step S108 if the moving direction of the cylinder rod 14*a* is in the expansion direction.

In step S108, the operation direction of the operating member 46*a* is detected by the operation detecting unit 46*b*. Next, in step S109, a determination is made as to whether the operation direction of the operating member 46*a* is the expansion direction. The process advances to step S110 if the operation direction of the operating member 46*a* is the expansion direction. In step S110, a determination is made as to whether the stroke position S is equal to or greater than a reduction start position S3 during the expansion operation. The process advances to step S111 if the stroke position S is equal to or greater than the reduction start position S3.

In step S111, the suction flow rate is controlled with the flow rate reduction characteristics for an expansion operation illustrated in FIG. 3(*b*). As illustrated in FIG. 3(*b*), the flow rate reduction characteristics prescribe changes in the suction flow rate with respect to the stroke position S so that the suction flow rate of the first hydraulic pump 12 when the stroke position S becomes closer to the stroke end Smax on the expansion side than a reference position S4 during the expansion operation, is equal to or less than a maximum discharge flow rate Qcmax of the charge pump 28.

FIG. 3(*b*) illustrates changes in the suction flow rate of the first hydraulic pump 12. The flow rate reduction control during an expansion operation is described in detail below. The process returns to step S101 if it is determined in step S107 that the moving direction of the cylinder rod 14*a* is not in the expansion direction. When a determination is made in step S109 that the operation direction of the operating member 46*a* is not the expansion direction, the process returns to step S101. Moreover, when a determination is made in step S110 that the stroke position S is not equal to or greater than a reduction start position S3 during an expansion operation, the process returns to step S101.

As described above, the suction flow rate is controlled with the flow rate reduction characteristics during a contraction operation illustrated in FIG. 3(*a*) when the hydraulic cylinder 14 is in a contraction operation. The suction flow rate is controlled with the flow rate reduction characteristics during an expansion operation illustrated in FIG. 3(*b*) when the hydraulic cylinder 14 is in the expansion operation.

In FIG. 3(*a*), Lmax indicates the flow rate reduction characteristics when the suction flow rate before the execution of the flow rate reduction control is the maximum flow rate. L1 indicates the flow rate reduction characteristics when the suction flow rate before the execution of the flow rate reduction control is a first flow rate that is less than the maximum flow rate. L2 indicates the flow rate reduction characteristics when the suction flow rate before the execution of the flow rate reduction control is a second flow rate that is less than the first flow rate.

The flow rate reduction characteristics have reduction portions in which the suction flow rate becomes smaller as the stroke position S approaches the stroke end. The slopes of the reduction portions of the flow rate reduction characteristics match each other. A change rate of the suction flow rate in the reduction portion of the flow rate reduction characteristics does not change regardless of the suction flow rate before the execution of the flow rate reduction control. However, the stroke positions S when the reduction of the suction flow rates has started in each of the flow rate reduction characteristics are different from each other. Specifically, the reduction start positions approach closer to the stroke end during the contraction operation as the suction flow rate before the execution of the flow rate reduction control becomes smaller. Specifically, a reduction start position S2a of the flow rate reduction characteristic L1 is smaller than a reduction start position S2 of the flow rate reduction characteristics Lmax. A reduction start position S2b of the flow rate reduction characteristic L2 is smaller than the reduction start position S2a of the flow rate reduction characteristics L1.

The suction flow rate is maintained at a prescribed flow rate Q0 in a prescribed range (between stroke positions 0 to S1) of the stroke position S that includes the stroke end during the contraction operation in the flow rate reduction characteristics. The prescribed flow rate Q0 is equal to or less than the maximum discharge flow rate Qcmax of the charge pump 28 and greater than zero.

In FIG. 3(*b*), Lmax' indicates the flow rate reduction characteristics when the suction flow rate before the execution of the flow rate reduction control is the maximum flow rate. L1' indicates the flow rate reduction characteristics when the suction flow rate before the execution of the flow rate reduction control is the first flow rate that is less than the maximum flow rate. L2' indicates the flow rate reduction characteristics when the suction flow rate before the execution of the flow rate reduction control is the second flow rate that is less than the first flow rate.

The flow rate reduction characteristics have reduction portions in which the suction flow rate becomes smaller as the stroke position S approaches the stroke end. The slopes of the reduction portions of the flow rate reduction characteristics match each other. A change rate of the suction flow rate in the reduction portion of the flow rate reduction characteristics does not change regardless of the suction flow rate before the execution of the flow rate reduction control. However, the stroke positions S when the reduction of the suction flow rates has started in each of the flow rate reduction characteristics are different from each other. Specifically, the reduction start positions approach closer to the stroke end during the expansion operation as the suction flow rate before the execution of the flow rate reduction control becomes smaller. Specifically, a reduction start position S3a of the flow rate reduction characteristic L1' is larger than a reduction start position S3 of the flow rate reduction characteristics Lmax'. A reduction start position S3b of the flow rate reduction characteristic L2' is larger than the reduction start position S3a of the flow rate reduction characteristics L1'.

The suction flow rate is maintained at a prescribed flow rate Q0' in a prescribed range (between stroke positions S4 to Smax) of the stroke position S that includes the stroke end during the expansion operation in the flow rate reduction characteristics. The prescribed flow rate Q0' is equal to or less than the maximum discharge flow rate Qcmax of the charge pump 28 and greater than zero. The prescribed flow rate Q0' in the flow rate reduction characteristics during an expansion operation may be the same as the prescribed flow rate Q0 in the flow rate reduction characteristics during a contraction operation. Alternatively, the prescribed flow rate Q0' in the flow rate reduction characteristics during an expansion operation may differ from the prescribed flow rate Q0 in the flow rate reduction characteristics during a contraction operation.

The hydraulic drive system 1 according to the present embodiment has the following features.

The pump control unit 24*a* in the flow rate reduction control reduces the suction flow rate so that the suction flow rate of the first hydraulic pump 12 and the second hydraulic pump 13 (or, the suction flow rate of the first hydraulic pump 12) is equal to or less than the maximum discharge flow rate Qcmax of the charge pump 28 when the stroke position S approaches the stroke end of the cylinder rod 14*a*. When the cylinder rod 14*a* reaches the stroke end and the suction pressure is reduced, the shortage of hydraulic fluid is replenished by hydraulic fluid from the charge pump 28. Since the suction flow rate of the first hydraulic pump 12 and the second hydraulic pump 13 (or, the suction flow rate of the first hydraulic pump 12) is reduced by the flow rate reduction control at this time, the amount of hydraulic fluid required for replenishing is smaller. Therefore, a shortage of hydraulic fluid can be replenished with hydraulic fluid from the charge pump 28 without making the charge pump 28 larger. As a result, the occurrence of a supply shortage of hydraulic fluid to the first hydraulic pump 12 and the second hydraulic pump 13 (or, hydraulic fluid to the first hydraulic pump 12) and an increase in the size of the charge pump 28 can be suppressed.

Since the suction flow rate is reduced in accompaniment to the stroke position S approaching the stroke end in the flow rate reduction characteristics illustrated in FIG. 3, it can be suppressed that the movement of the hydraulic cylinder 14 become slow drastically. Moreover, since the change rate of the suction flow rate in the reduction portion of the flow rate reduction characteristics does not change regardless of the suction flow rate before the execution of the flow rate reduction control, variations in changes of the operation speed of the hydraulic cylinder 14 can be suppressed.

In the flow rate reduction characteristics illustrated in FIG. 3(*a*), hydraulic fluid of the prescribed flow rate Q0 is sucked into the first hydraulic pump 12 and the second hydraulic pump 13 even when the stroke position S has reached the stroke end. In the flow rate reduction characteristics illustrated in FIG. 3(*b*), hydraulic fluid of the prescribed flow rate Q0' is sucked into the first hydraulic pump 12 even when the stroke position S has reached the stroke end. Therefore, the proximal end part of the cylinder rod 14 moves at a low speed and makes contact with the end part on the inside surface of the cylinder tube 14*b*. As a result, the operator is able to easily know when the stroke position S reaches the stroke end.

The suction flow rate is controlled according to different flow rate reduction characteristics during an expansion operation and during a contraction operation of the hydraulic cylinder 14. As a result, the suction flow rate can be controlled with flow rate reduction characteristics that suit the operating state of the hydraulic cylinder 14. For example, the flow rate of hydraulic fluid returning from the hydraulic cylinder 14 to the first hydraulic pump 12 and the second hydraulic pump 13 differs depending on whether the hydraulic cylinder 14 is in an expansion operation or a contraction operation. Therefore, the control of a suction flow rate suited to the flow rate differences can be performed through the use of different flow rate reduction characteristics during an expansion operation or a contraction operation of the hydraulic cylinder 14.

Whether the cylinder rod is expanding or contracting can be determined according to both the operating direction of the operating member 46*a* and the moving direction of the cylinder rod 14*a*. As a result, suitable flow rate reduction characteristics can be selected even if for example the hydraulic cylinder 14 moved in a direction opposite the operating direction of the operating member 46*a* due to inertia immediately after the operating direction of the operating member 46*a* is switched to the opposite direction.

Although an embodiment of the present invention has been described so far, the present invention is not limited to the above embodiments and various modifications may be made within the scope of the invention.

Figure 4:
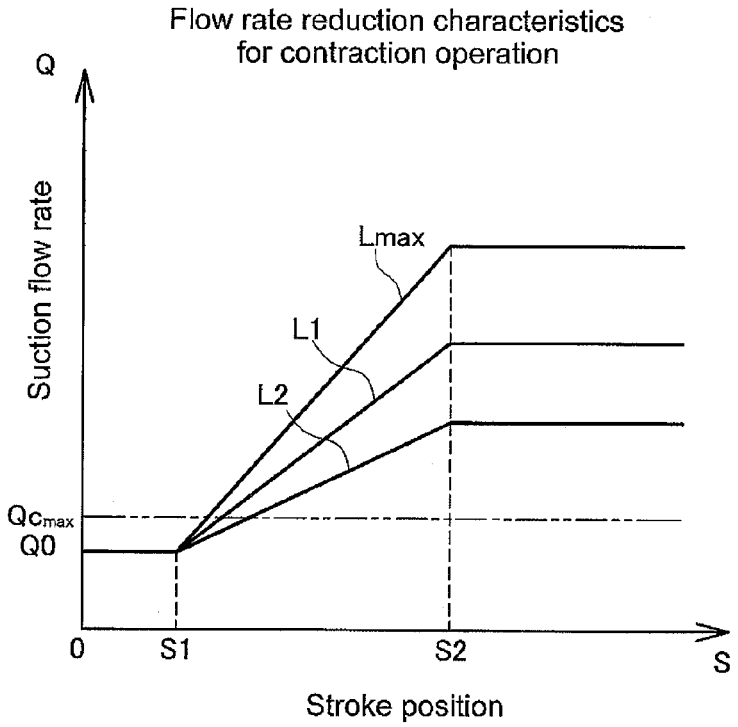
FIG. 4 illustrates graphs describing flow rate reduction characteristics according to a first modified example.
Figure 4:
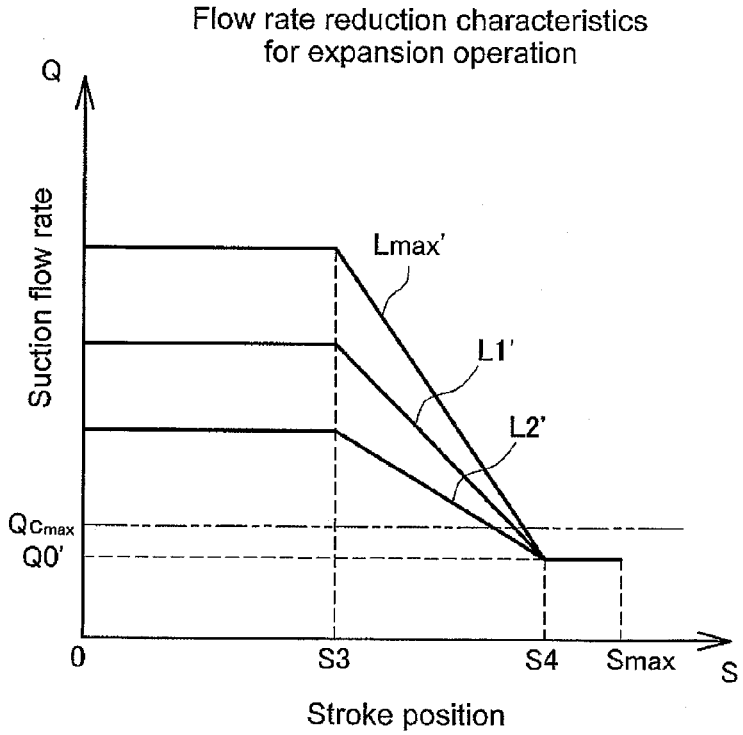

For example, flow rate reduction characteristics different from the flow rate reduction characteristics illustrated in FIG. 3 may be used. FIG. 4 illustrates graphs describing flow rate reduction characteristics according to a first modified example. FIG. 4(*a*) illustrates flow rate reduction characteristics during a contraction operation. FIG. 4(*b*) illustrates flow rate reduction characteristics during an expansion operation.

The change rate of the suction flow rate in the reduction portion of the flow rate reduction characteristics changes in response to the suction flow rate before the execution of the flow rate reduction control as illustrated in FIG. 4(*a*). Specifically, the size of the slope of the flow rate reduction characteristics L1 is smaller than the size of the slope of the flow rate reduction characteristics Lmax. The size of the slope of the flow rate reduction characteristics L2 is smaller than the size of the slope of the flow rate reduction characteristics L1. The change rate of the suction flow rate in the reduction portion of the flow rate reduction characteristics becomes smaller as the suction flow rate before the execution of the flow rate reduction control becomes smaller.

Moreover, the stroke position S when the reduction of the suction flow rate has started is the same regardless of the suction flow rate before the execution of the flow rate reduction control. Specifically, the reduction in the suction flow rate is started at any of the reduction start positions S2 for the flow rate reduction characteristics Lmax, the flow rate reduction characteristics L1, and the flow rate reduction characteristics L2. The suction flow rate reaches the prescribed flow rate Q0 that is equal to or less than the maximum discharge flow rate Qcmax of the charge pump 28 at the same stroke position S for the flow rate reduction characteristics Lmax, the flow rate reduction characteristics L1, and the flow rate reduction characteristics L2. Specifically, the suction flow rate reaches the prescribed flow Q0 at any of the reference positions S1 for the flow rate reduction characteristics Lmax, the flow rate reduction characteristics L1, and the flow rate reduction characteristics L2.

The change rate of the suction flow rate in the reduction portion of the flow rate reduction characteristics changes in response to the suction flow rate before the execution of the flow rate reduction control as illustrated in FIG. 4(*b*) in the same way as the flow rate reduction characteristics illustrated in FIG. 4(*a*). Specifically, the size of the slope of the flow rate reduction characteristics L1' is smaller than the size of the slope of the flow rate reduction characteristics Lmax'. The size of the slope of the flow rate reduction characteristics L2' is smaller than the size of the slope of the flow rate reduction characteristics L1'. The change rate of the suction flow rate in the reduction portion of the flow rate reduction characteristics becomes smaller as the suction flow rate before the execution of the flow rate reduction control becomes smaller.

Moreover, the stroke position S when the reduction of the suction flow rate has started is the same regardless of the suction flow rate before the execution of the flow rate reduction control. Specifically, the reduction in the suction flow rate is started at any of the reduction start positions S3 for the flow rate reduction characteristics Lmax', the flow rate reduction characteristics L1', and the flow rate reduction characteristics L2'. The suction flow rate reaches the prescribed flow rate Q0' that is equal to or less than the maximum discharge flow rate Qcmax of the charge pump 28 at the same stroke position S for the flow rate reduction characteristics Lmax', the flow rate reduction characteristics L1', and the flow rate reduction characteristics L2'. Specifically, the suction flow rate reaches the prescribed flow Q0' at any of the reference positions S4 for the flow rate reduction characteristics Lmax', the flow rate reduction characteristics L1', and the flow rate reduction characteristics L2'. Other features of the flow rate reduction characteristics according to the first modified example are the same as those of the flow rate reduction characteristics according to the above embodiment.

Figure 5:
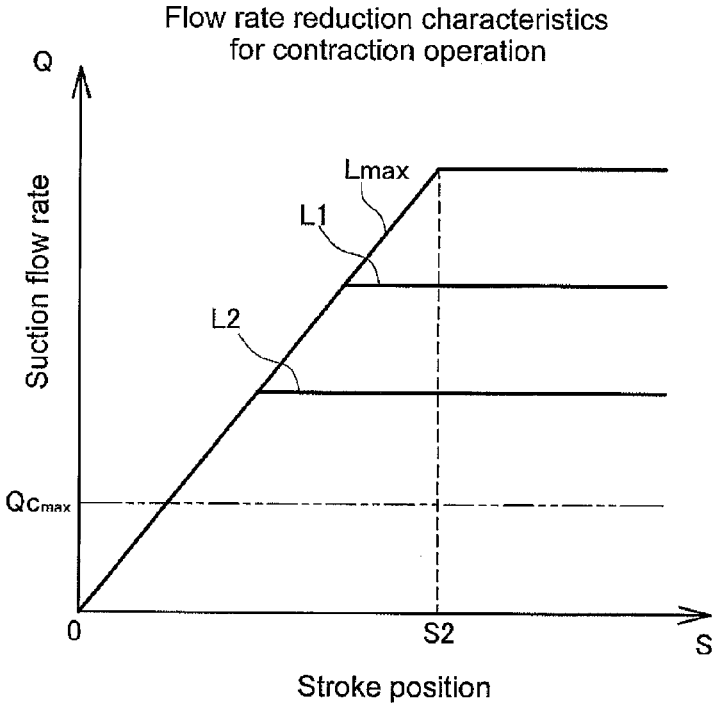
FIG. 5 illustrates graphs describing flow rate reduction characteristics according to a second modified example.
Figure 5:
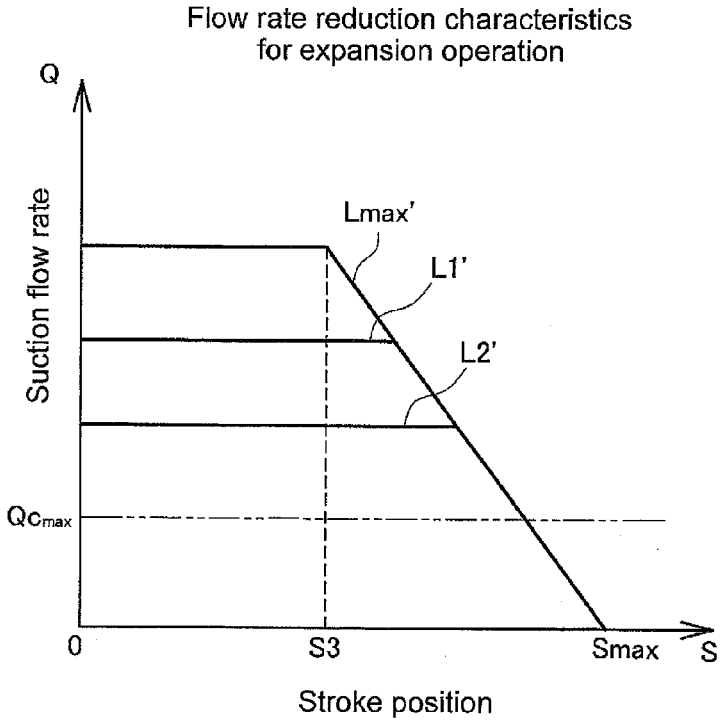

FIG. 5 illustrates graphs describing flow rate reduction characteristics according to a second modified example. FIG. 5(*a*) illustrates flow rate reduction characteristics during a contraction operation. FIG. 5(*b*) illustrates flow rate reduction characteristics during an expansion operation. As illustrated in FIG. 5(*a*), the suction flow rate reaches zero when the stroke position S reaches the stroke end during a contraction operation for the flow rate reduction characteristics Lmax, L1, and L2. Specifically, the suction flow rate reaches zero at the same time that the stroke position S reaches the stroke end during a contraction operation. As illustrated in FIG. 5(*b*), the suction flow rate reaches zero when the stroke position S reaches the stroke end during an expansion operation for the flow rate reduction characteristics Lmax', L1', and L2'. Specifically, the suction flow rate reaches zero at the same time that the stroke position S reaches the stroke end during an expansion operation. Other features of the flow rate reduction characteristics according to the second modified example are the same as those of the flow rate reduction characteristics according to the above embodiment.

Figure 6:
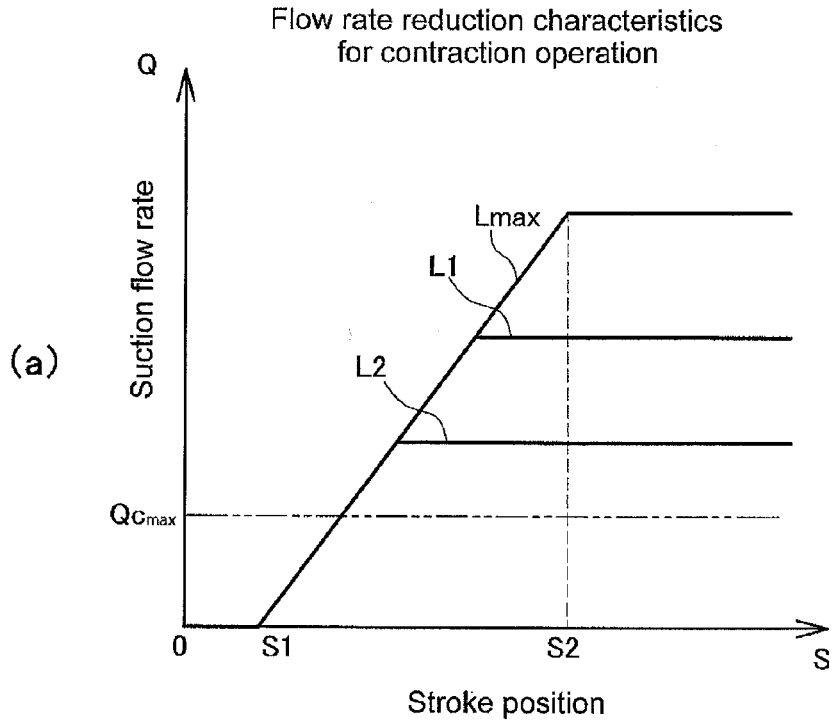
FIG. 6 illustrates graphs describing flow rate reduction characteristics according to a third modified example.
Figure 6:
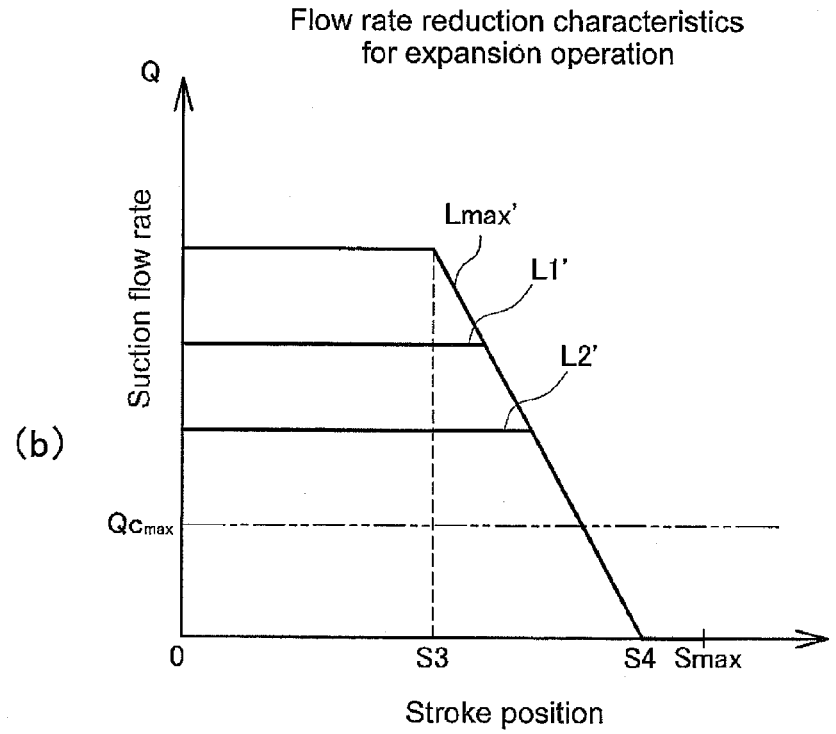

FIG. 6 illustrates graphs describing flow rate reduction characteristics according to a third modified example. FIG. 6(*a*) illustrates flow rate reduction characteristics during a contraction operation. FIG. 6(*b*) illustrates flow rate reduction characteristics during an expansion operation. As illustrated in FIG. 6(*a*), the suction flow rate reaches zero before the stroke position S reaches the stroke end during a contraction operation for the flow rate reduction characteristics Lmax, L1, and L2 during the contraction operation. Specifically, the suction flow rate reaches zero when the stroke position S reaches the reference position S1 during a contraction operation for the flow rate reduction characteristics Lmax, L1, and L2 during the contraction operation. As illustrated in FIG. 6(*b*), the suction flow rate reaches zero before the stroke position S reaches the stroke end during an expansion operation for the flow rate reduction characteristics Lmax', L1', and L2' during the expansion operation. Specifically, the suction flow rate reaches zero when the stroke position S reaches the reference position S4 during a contraction operation for the flow rate reduction characteristics Lmax', L1', and L2' during the contraction operation. Other features of the flow rate reduction characteristics according to the third modified example are the same as those of the flow rate reduction characteristics according to the above embodiment.

The flow rate reduction characteristics according to the first modified example may be corrected so that the suction flow rate reaches zero when the stroke position S reaches the stroke end during a contraction operation in the same way as the flow rate reduction characteristics according to the second modified example. Alternatively, the flow rate reduction characteristics according to the first modified example may be corrected so that the suction flow rate reaches zero before the stroke position S reaches the stroke end during a contraction operation in the same way as the flow rate reduction characteristics according to the third modified example.

Figure 7:
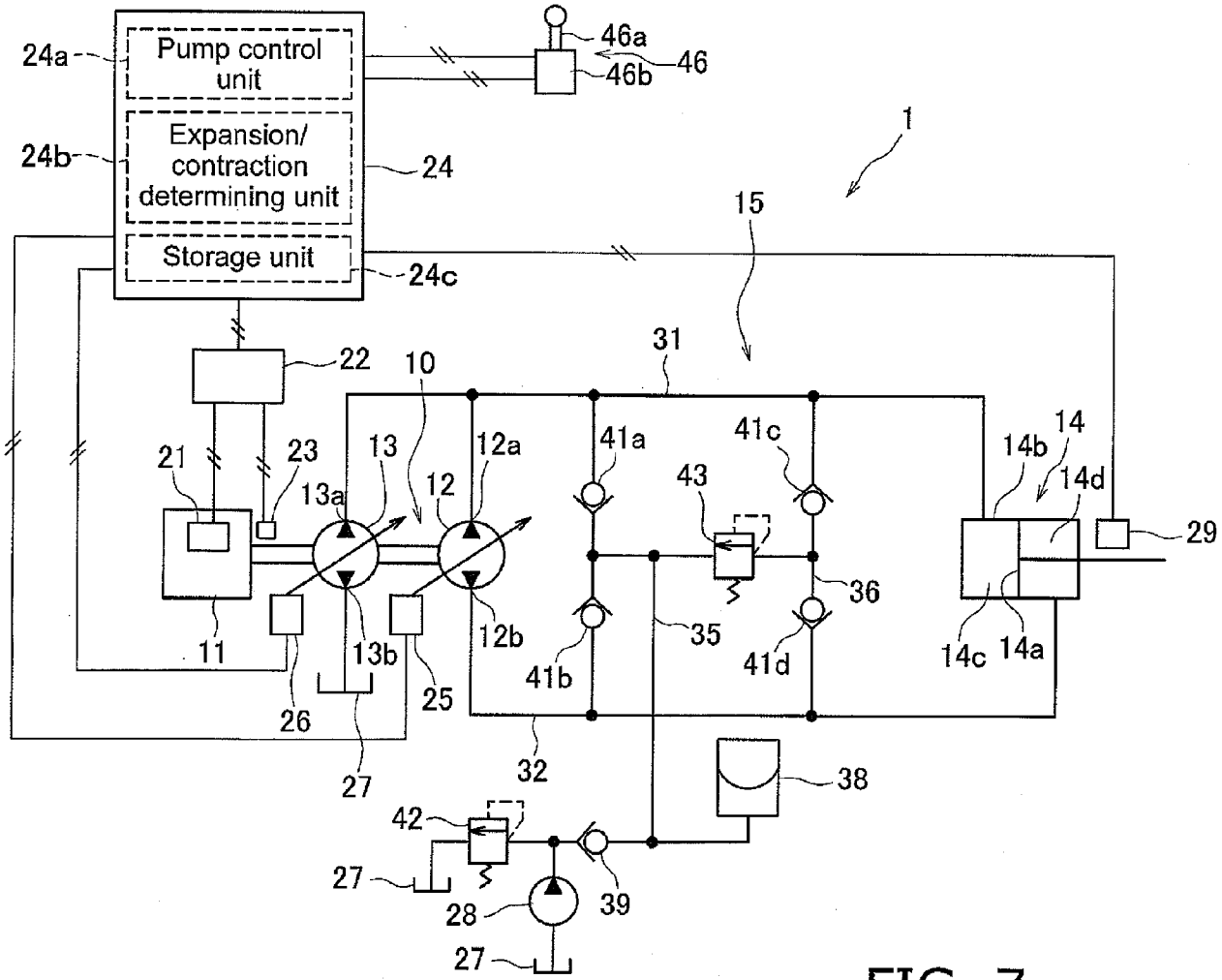
FIG. 7 is a block diagram of a configuration of a hydraulic drive system according to another embodiment of the present invention.

The configuration of the hydraulic drive system 1 is not limited to the configuration of the hydraulic drive system 1 described above. For example, as illustrated in FIG. 7, an accumulator 38 may be connected to the charge path 35. The accumulator 38 is connected to the charge pump 28 via a check valve 39. The check valve 39 allows the flow of hydraulic fluid from the charge pump 28 toward the accumulator 38 and prohibits the flow of hydraulic fluid from the accumulator 38 toward the charge pump 28 in the charge path 35. Hydraulic fluid can be replenished to the charge path 35 with hydraulic fluid stored in the accumulator 38. As a result, an increase in the size of the charge pump 28 can be further suppressed.

While the present invention is applicable to a twin pump hydraulic drive system in which two hydraulic pumps 12 and 13 are connected to the hydraulic cylinder 14 in the above embodiment, the present invention may also be applicable to a single pump hydraulic drive system in which one hydraulic pump is connected to the hydraulic cylinder 14. The driving source is not limited to an engine and may be an electric motor. In this case, a fixed displacement hydraulic pump may be used for the hydraulic pump in place of the variable displacement hydraulic pumps such as the above-mentioned hydraulic pumps 12 and 13. The suction flow rate of the fixed displacement hydraulic pump may be controlled by controlling the rotation speed of the electric motor.

While the flow rate reduction control is executed for both the expansion operation and the contraction operation in the above embodiment, the flow rate reduction control may also be executed for either one of the expansion operation or the contraction operation A hydraulic drive system that is able to suppress the generation of a supply shortage of hydraulic fluid to a hydraulic pump and suppress an increase in the size of a charge pump can be provided according to the present invention.

What is claimed is:

1. A hydraulic driving system comprising:

a hydraulic cylinder including a cylinder tube and a cylinder rod, the cylinder tube having a first end part and a second end part, the cylinder rod having a proximal end part inserted inside the cylinder tube such that the proximal end part can move reciprocally between the first end part and the second end part, the proximal end part of the cylinder rod partitioning an inside of the cylinder tube into a first chamber disposed between the first end part and the proximal end part and a second chamber disposed between the proximal end part and the second end part, the cylinder rod being configured to move in an expansion direction such that the first chamber expands when hydraulic fluid is supplied to the first chamber and exhausted from the second chamber, the cylinder rod being configured to move in a contraction direction such that the first chamber contracts when hydraulic fluid is supplied to the second chamber and exhausted from the first chamber;

a main pump switchable between a state of supplying hydraulic fluid to the first chamber and sucking in hydraulic fluid from the second chamber, and a state of supplying hydraulic fluid to the second chamber and sucking in hydraulic fluid from the first chamber;

a hydraulic-fluid path connecting the first chamber and the main pump, the hydraulic-fluid path also connecting the second chamber and the main pump, the hydraulic-fluid path forming a closed circuit between the main pump and the hydraulic cylinder;

a charge pump configured to replenish hydraulic fluid in the hydraulic-fluid path, the charge pump having a maximum discharge flow rate that is smaller than a maximum suction flow rate of the main pump;

a stroke position detector configured to detect a stroke position of the proximal end part of the cylinder rod inside the cylinder tube; and a pump controller arranged to receive a signal indicating the stroke position from the stroke position detector, the pump controller being programmed to execute a flow rate reduction control when a distance from the stroke position detected by the stroke position detector to a stroke end where the proximal end part of the cylinder rod contacts the first end part or the second end part of the cylinder tube is equal to or smaller than a distance from a reduction start position to the stroke end, the flow rate reduction control being configured to reduce a suction flow rate of the main pump as the stroke position approaches a reference position so that the suction flow rate is equal to or less than the maximum discharge flow rate of the charge pump when the stroke position is in a range spanning between the reference position and the stroke end, the reduction start position and the reference position being different from each other and different from the stroke end, the reference position being disposed between the reduction start position and the stroke end.

2. The hydraulic drive system according to claim 1, wherein the pump controller is configured to control the suction flow rate in accordance with a flow rate reduction characteristic that prescribes a change in the suction flow rate with respect to the stroke position during the flow rate reduction control, the flow rate reduction characteristics having a reduction portion in which the suction flow rate becomes smaller as the stroke position approaches the stroke end, and a change rate of the suction flow rate in the reduction portion of the flow rate reduction characteristic does not change regardless of a suction flow rate before execution of the flow rate reduction control.

3. The hydraulic drive system according to claim 2, wherein the smaller a suction flow rate is before the execution of the flow rate reduction control, the closer the reduction start position is set to the stroke end.

4. The hydraulic drive system according to claim 1, wherein the pump controller is configured to control the suction flow rate in accordance with a flow rate reduction characteristic that prescribes a change in the suction flow rate with respect to the stroke position during the flow rate reduction control, the flow rate reduction characteristic having a reduction portion in which the suction flow rate is reduced as the stroke position approaches the stroke end, and a change rate of the suction flow rate in the reduction portion of the flow rate reduction characteristic changes in response to a suction flow rate before an execution of the flow rate reduction control.

5. The hydraulic drive system according to claim 4, wherein the smaller a suction flow rate is before the execution of the flow rate reduction control, the smaller a change rate of the suction flow rate in the reduction portion of the flow rate reduction characteristic becomes.

6. The hydraulic drive system according to claim 5, wherein the reduction start position is the same regardless of the suction flow rate before the execution of the flow rate reduction control.

7. The hydraulic drive system according to claim 2, wherein the suction flow rate is maintained at a prescribed flow rate equal to or less than the maximum discharge flow rate of the charge pump when the stroke position is in the range spanning between the reference position and the stroke end in the flow rate reduction characteristic.

8. The hydraulic drive system according to claim 2, wherein the suction flow rate reaches zero when the stroke position reaches the stroke end in the flow rate reduction characteristic.

9. The hydraulic drive system according to claim 2, wherein the suction flow rate reaches zero before the stroke position reaches the stroke end, in the flow rate reduction characteristic.

10. The hydraulic drive system claim 2, wherein the pump controller is further programmed to determine whether the hydraulic cylinder is operating in a state of expanding or a state of contracting;

select one of an expansion operation flow rate reduction characteristic and a contraction operation flow rate reduction characteristic as the flow rate reduction characteristic depending on whether the hydraulic cylinder is determined to be in the state of expanding or the state of contracting;

control the suction flow rate in accordance with the expansion operation flow rate reduction characteristic during the flow rate reduction control when the hydraulic cylinder is in the state of expanding; and control the suction flow rate in accordance with the contraction operation flow rate reduction characteristic during the flow rate reduction control when the hydraulic cylinder is in the state of contracting.

11. A hydraulic driving system comprising:

a hydraulic cylinder including a cylinder tube and a cylinder rod, the cylinder tube having a first end part and a second end part, the cylinder rod having a proximal end part inserted inside the cylinder tube such that the proximal end part can move reciprocally between the first end part and the second end part, the proximal end part of the cylinder rod partitioning inside of the cylinder tube into a first chamber disposed between the first end part and the proximal end part and a second chamber disposed between the proximal end part and the second end part, the cylinder rod being configured to move in an expansion direction such that the first chamber expands when hydraulic fluid is supplied to the first chamber and exhausted from the second chamber, the cylinder rod being configured to move in a contraction direction such that the first chamber contracts when hydraulic fluid is supplied to the second chamber and exhausted from the first chamber;

a main pump switchable between a state of supplying hydraulic fluid to the first chamber and sucking in hydraulic fluid from the second chamber, and a state of supplying hydraulic fluid to the second chamber and sucking in hydraulic fluid from the first chamber;

a hydraulic-fluid path connecting the first chamber and the main pump, the hydraulic-fluid path also connecting the second chamber and the main pump, the hydraulic-fluid path forming a closed circuit between the main pump and the hydraulic cylinder;

a charge pump configured to replenish hydraulic fluid in the hydraulic-fluid path, the charge pump having a maximum discharge flow rate that is smaller than a maximum suction flow rate of the main pump;

a stroke position detector configured to detect a stroke position of the proximal end part of the cylinder rod inside the cylinder tube;

an operating member configured to be manipulated by an operator to operate the hydraulic cylinder;

an operation detector arranged and configured to detect at least an operation direction of the operating member and to feed a detection signal to the pump controller; and a pump controller arranged to receive a signal indicating the stroke position from the stroke position detector, the pump controller being programmed to execute a flow rate reduction control when a distance from the stroke position detected by the stroke position detector to a stroke end where the proximal end part of the cylinder rod contacts the first end part or the second end part of the cylinder tube is equal to or smaller than a distance from a prescribed reduction start position to the stroke end, the flow rate reduction control being configured to reduce a suction flow rate of the main pump as the stroke position approaches a the stroke end from the reduction start position, the flow rate reduction control being configured to control the suction flow rate in accordance with one of an expansion operation flow rate reduction characteristic and a contraction operation flow rate reduction characteristic in accordance with a moving direction of the cylinder rod, each of the expansion operation flow rate reduction characteristic and the contraction operation flow rate reduction characteristic prescribing a change in the suction flow rate with respect to the stroke position during the flow rate reduction control, each of the expansion operation flow rate reduction characteristic and the contraction operation flow rate reduction characteristic having a reduction portion in which the suction flow rate becomes smaller as the stroke position approaches the stroke end, a change rate of the suction flow rate in the reduction portion not changing regardless of a suction flow rate before execution of the flow rate reduction control, the pump controller being further programmed to determine whether the cylinder rod is moving in the expansion direction or the contraction direction based on detection results of the stroke position detector, determine whether the operating member is being operated in a direction corresponding to the expansion direction of the hydraulic cylinder or the contraction direction of the hydraulic cylinder based on the detection signal from the operation detector, and determine that the cylinder rod is performing an expansion operation or a contraction operation upon the moving direction of the cylinder rod matching the operation direction of the operating member, control the suction flow rate in accordance with the expansion operation flow rate reduction characteristic during the flow rate reduction control when the hydraulic cylinder is performing the expansion operation, and control the suction flow rate in accordance with the contraction operation flow rate reduction characteristic during the flow rate reduction control when the hydraulic cylinder is performing the contraction operation.

12. The hydraulic drive system according to claim 10, wherein a flow rate of hydraulic fluid returning to the main pump from the hydraulic cylinder during a contraction operation is greater than a flow rate of hydraulic fluid returning to the main pump from the hydraulic cylinder during an expansion operation.

13. The hydraulic drive system according to claim 1, wherein the suction flow rate of the main pump is larger than the maximum discharge flow rate of the charge pump when the proximal end part of the cylinder rod is at the reduction start position.

* * * * *